US006138842A

United States Patent [19]

Rios

[11] Patent Number: 6,138,842

[45] Date of Patent: Oct. 31, 2000

[54] POINT OF SALE DISPLAY

[75] Inventor: Ciro Rios, Miami, Fla.

[73] Assignee: CRR Biomedical, Inc., Miami, Fla.

[21] Appl. No.: 09/502,657

[22] Filed: Feb. 11, 2000

[51] Int. Cl.[7] ..... A47F 3/14; A47F 5/06; A47F 57/00

[52] U.S. Cl. ..... 211/133.4; 211/2; 211/196

[58] Field of Search ..... 211/133.4, 133.1, 211/132.1, 208, 207, 2, 128.1, 126.6, 196

[56] References Cited

U.S. PATENT DOCUMENTS 3,771,665 11/1973 Potter ..... 211/208 X
5,660,404 8/1997 Dilley ..... 211/133.1 X

*Primary Examiner*—Daniel P. Stodola
*Assistant Examiner*—Erica B. Harris
*Attorney, Agent, or Firm*—J. Sanchelima

[57] ABSTRACT

A point of sale display with a collapsible base assembly removably mounted to one end of an elongated tubular member with a square cross-section. The elongated tubular member includes a lateral wall with slots therealong to receive the ends of supporting walls and arm assemblies that are removably mounted to the longitudinal walls in perpendicular relationship thereto. In one alternative embodiment two of the supporting walls are hingedly mounted, otherwise they include lateral hook terminations. Flat portions are removably mounted on the supporting walls and arm assemblies to provide flat surfaces kept at spaced apart and parallel relationship with respect to each other to support goods in display. In another configuration, the elongated tubular member is used as a wheelbarrow by transferring the weight of the display to the wheel assembly, at one end of the elongated tubular member.

3 Claims, 4 Drawing Sheets

POINT OF SALE DISPLAY

BACKGROUND OF THE INVENTION

1. Field of the Invention

The present invention relates to point of sale displays, and more particularly, to displays that can be readily dismountable and used as a wheelbarrow.

2. Description of the Related Art

Many designs for point of sale displays have been designed in the past. None of them, however, include a readily dismountable mechanism that converts the display for ready transportation as a wheelbarrow with cargo space capacity. This invention provides a volumetrically efficient solution to the transportation logistics faced by users of point of sale displays, such as salespersons and employees that need to move displays from one location to another. These displays are frequently transported to and from various shows and retail establishments. With the present invention, a user may utilize the display and transport it in a different configuration.

SUMMARY OF THE INVENTION

It is one of the main objects of the present invention to provide a point of sale display that can be readily assembled and disassembled.

It is another object of the present invention to provide a display that can be readily converted to a wheelbarrow with cargo capacity.

It is another object of this invention to provide a point of sale display with adjustable shelves.

It is still another object of the present invention to provide a point of sale display that is volumetrically efficient for transportation and storage.

The present invention allows a user to store additional objects on the top tray such as documentation, electrical power supplies or batteries, sensors, lights and other electronic devices, to make the display smart and activate upon the detection of different conditions like the approach of a person (potential customer) and activating audio announcers or lights, or removal of products from the display (for the purposes of refilling or counting inventory), and keeping these devices out of the public's sight.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 6 illustrates an exploded view of the embodiment shown in FIG. 1 in the wheelbarrow configuration.

DETAILED DESCRIPTION OF THE PREFERRED EMBODIMENT

Figure 1:
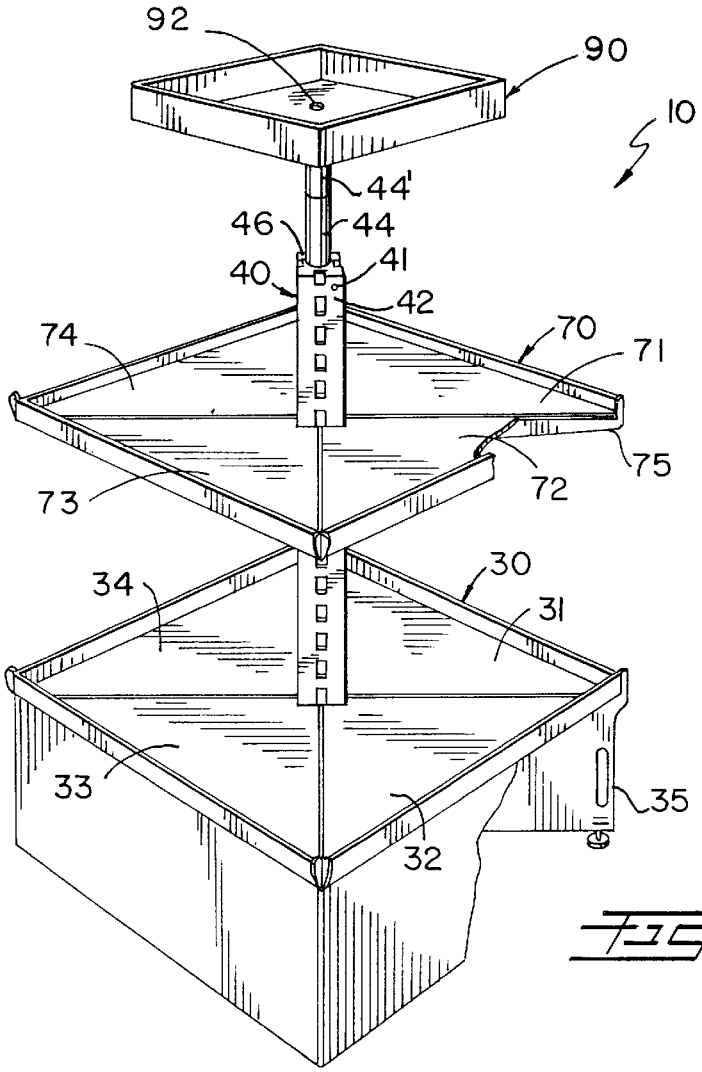
FIG. 1 represents a tilted isometric view of one of the preferred embodiments of the invention in the point of sale display configuration.

Referring now to the drawings, where the present invention is generally referred to with numeral 10, it can be observed that it basically includes base assembly 20, elongated tubular assembly 40 with first and second ends 46 and 48 and tray assemblies 30 and 70. These assemblies can be used for a point of sale configuration, as shown in FIG. 1, or in a wheelbarrow configuration as shown in FIG. 2.

Figure 3:
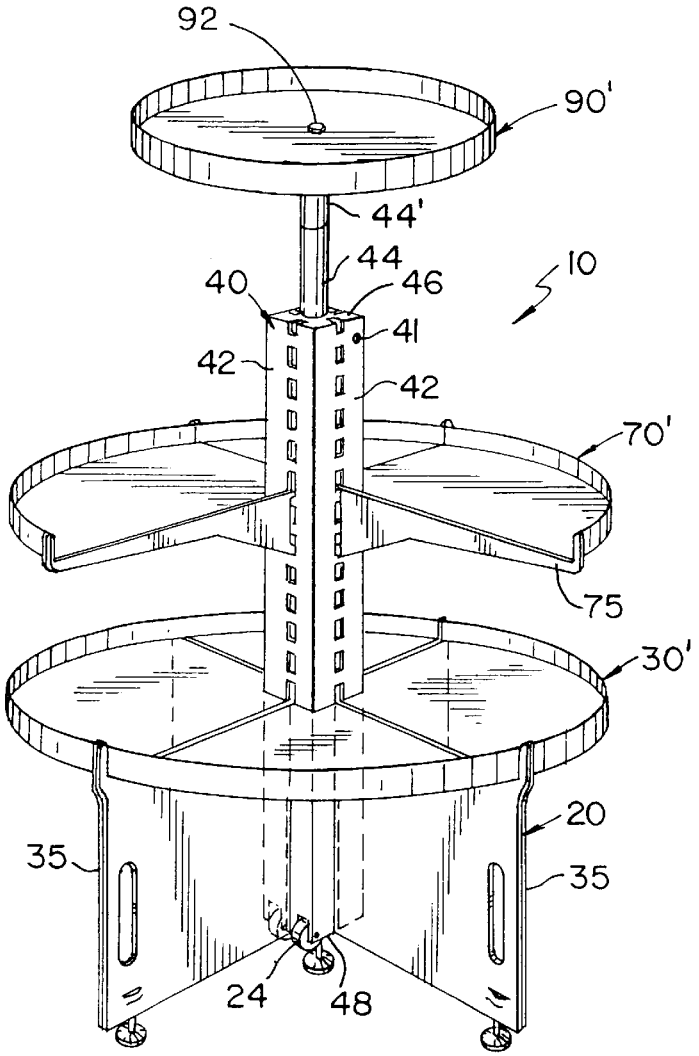
FIG. 3 is a tilted isometric view of an alternative embodiment for the present invention wherein the horizontal tray sections have a curved outer edge forming a circular perimeter.

Tray assembly 30 is composed of four triangular (as shown in FIG. 1) or non-triangular (as shown in FIG. 3) tray sections 31; 32; 33 and 34 that define a horizontal surface where goods for display are placed. In the preferred embodiment shown in FIG. 1, supporting wall assemblies 35 compose a set and are removably mounted to each of the four longitudinal walls 42 of tubular assembly 40, as best seen in FIG. 3. Arm assemblies 75 support tray assembly 70. Support tray assembly 70 includes tray sections 71, 72, 73, and 74. There may be more tray assemblies like assembly 70. When mounted to tubular assembly 40, supporting wall assemblies 35 of a given set extend outwardly on the same plane. Wall assemblies 35 and arm assemblies 75 are positioned in a spaced apart and parallel relationship with respect to each other to keep tray assemblies 30 and 70 also at a spaced apart and parallel relationship with respect to each other. Handles 44 and 44', removably attached end to end from one another are in turn removably attached to the first end 46 of tubular assembly 40.

Top tray assembly 90 is kept at a separate and spaced apart relationship with respect to tray assembly 70. Assembly 90 can be used to support promotional displays. Fastening member 92 keeps assembly 90 mounted to the uppermost end of handle member 44'.

Figure 2:
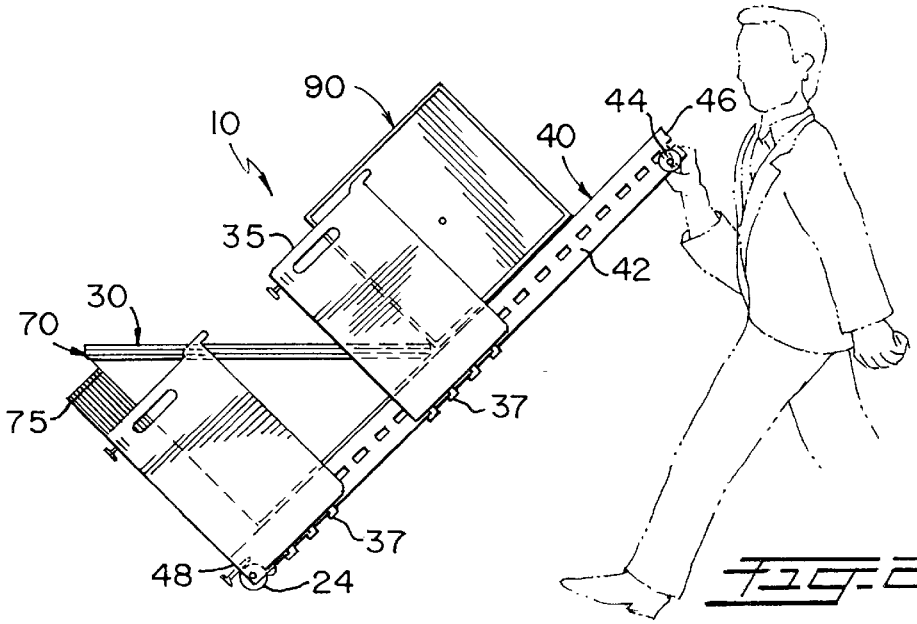
FIG. 2 shows a side elevational view of the invention in the wheelbarrow configuration.

FIG. 2 illustrates the present invention 10, in the wheelbarrow configuration. The user attaches supporting wall assemblies 35 at predetermined locations utilizing lateral hooks 39 removably mounted to longitudinal walls 42 of elongated tubular assembly 40, as best seen in FIG. 6. Handles 44 and 44' are secured near the first end 46 and at opposite faces of elongated tubular assembly 40 thread holes 41. When tilted towards the user, wheel assembly 24, near the second end 48 of elongated tubular assembly 40, is free to rotate, thus allowing the user to transport the instant invention and its cargo in a wheelbarrow configuration.

Figure 3A:
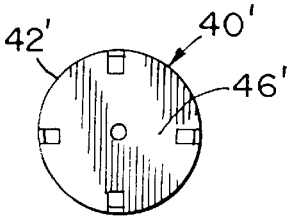
FIG. 3*a* is a top view of the alternative tubular assembly.
Figure 3B:
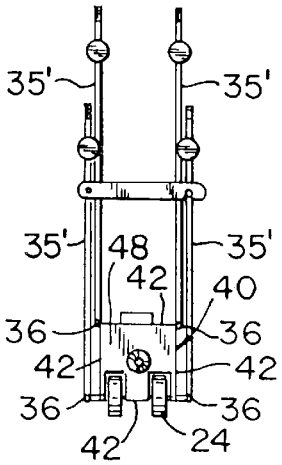
FIG. 3*b* illustrates an alternative variation of wall assemblies hingedly mounted to the corners of the longitudinal walls.

Tubular assembly 40 can also have a non-rectangular cross-section, as shown in FIG. 3*a*. FIG. 3*b* shows a variation where wall assemblies 35' are hingedly mounted to the corners of longitudinal walls 42. Hinges 36 are positioned in predetermined locations so that wall assemblies 35' cooperate to define a cargo space.

Figure 4:
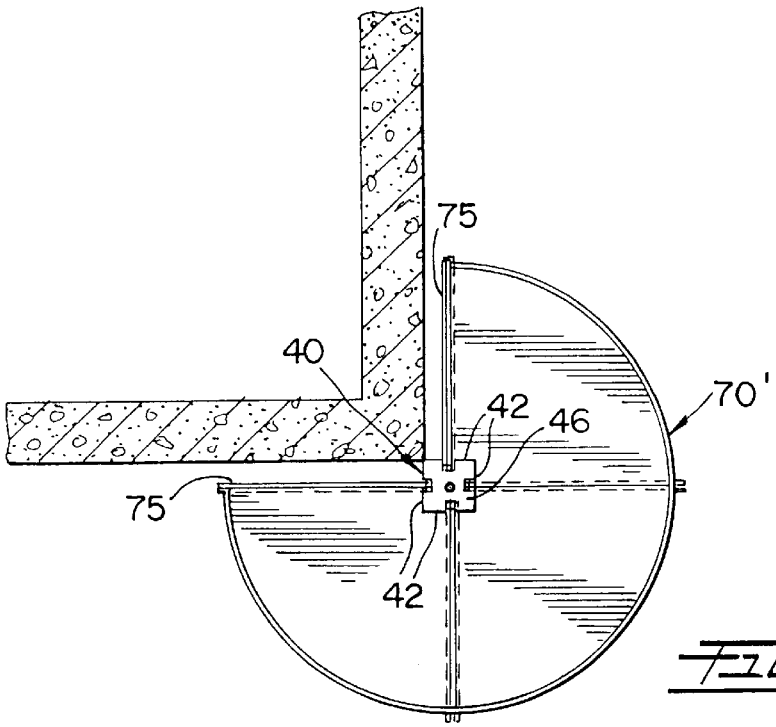
FIG. 4 is a representation of a top view of another alternative embodiment in the point of sale configuration being used with a 270 degree corner.
Figure 5:
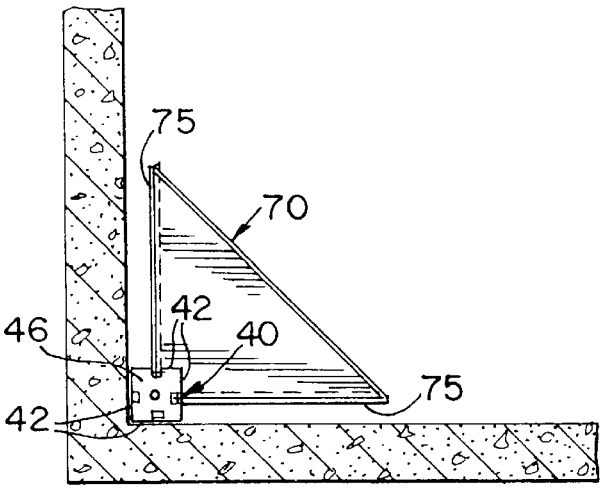
FIG. 5 is a representation of a top view of another alternative embodiment in the point of sale configuration being used with a 90 degree corner.
Figure 5:
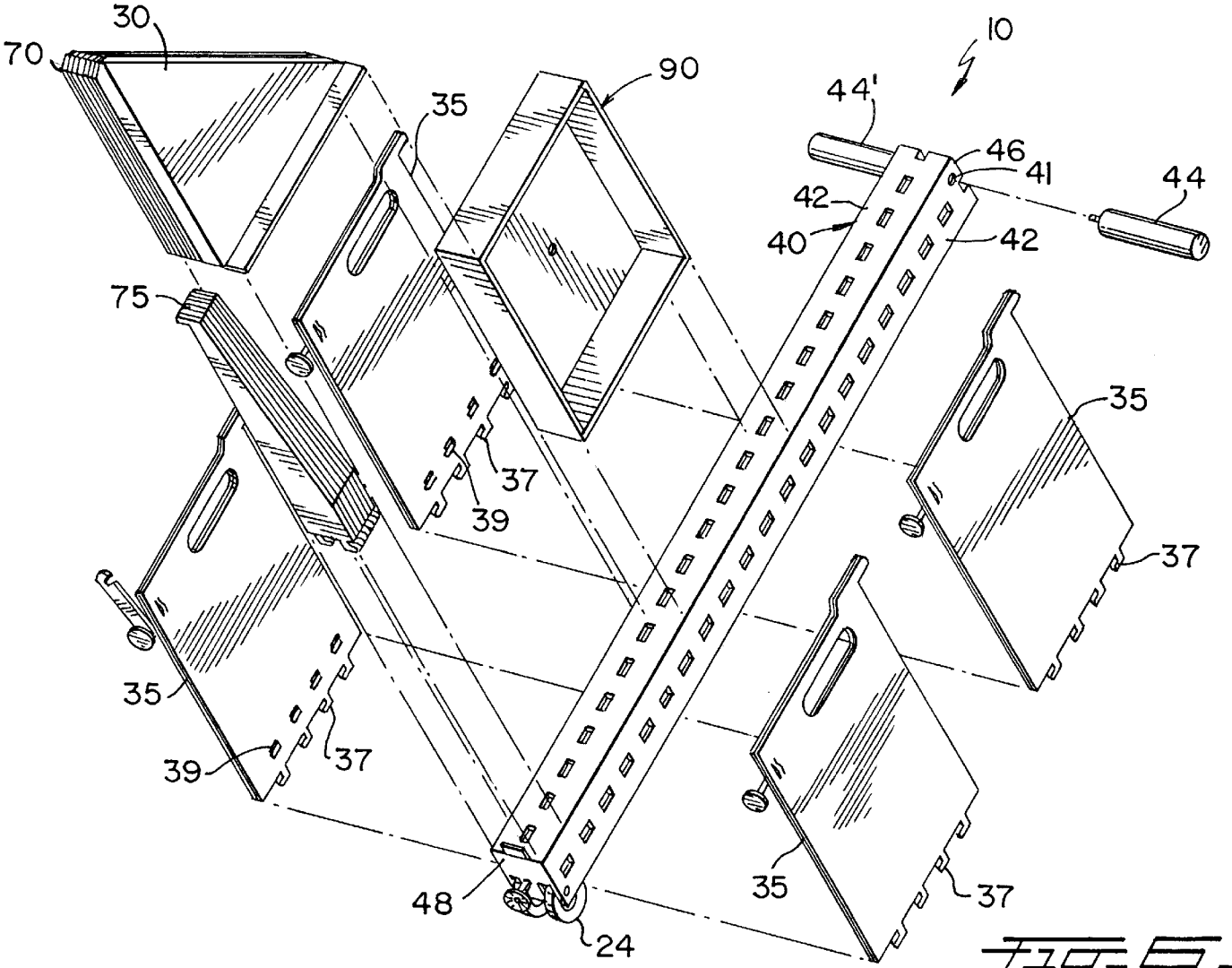

FIG. 4 depicts a variation of the instant invention when utilized in the point of sale configuration and stationed adjacent to a 270 degree corner. In FIG. 5, only one tray assembly 70, is utilized for another alternative embodiment in the point of sale configuration being used with a 90 degree corner.

FIG. 6 depicts an exploded view of the present invention in the wheelbarrow configuration shown in FIG. 2. This view shows the mounting position of the different parts. As it can be seen, supporting wall assemblies 35 include two sets of hook terminations. One set being the end hooks 37 for perpendicular mounting with respect to longitudinal walls 42. The other set corresponds to the lateral hooks 39 for parallel engagement with walls 42 to configure the wheelbarrow.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A point of sale display, comprising:

A) an elongated tubular member having first and second ends, and a lateral wall, said lateral wall including a plurality of slots, said first end including a wheel assembly extending perpendicularly outwardly from said lateral wall and a flange member on said lateral wall opposite to said wheel assembly;

B) a base assembly having at least two supporting walls including means for removably and perpendicularly mounting said supporting walls to said elongated tubular member adjacent to said first end, said supporting walls being cooperatively disposed to support a flat portion, and said supporting walls further including means for removably mounting said supporting walls in parallel relationship with respect to said elongated tubular member so that in a wheelbarrow configuration said supporting walls can be mounted with at least one pair of said supporting walls in parallel and spaced relationship with respect to each other thereby defining a space in between for storage, and further including latch means for keeping said two supporting walls in place and providing, in cooperation with said flange member, two resting surfaces; and C) a first tray assembly perpendicularly and removably mounted to said elongated tubular member at a predetermined position, said tray assembly including at least one flat portion removably mounted to said elongated tubular member and being supported by said supporting walls.

2. The display set forth in claim 1 further including:

D) at least one second tray assembly perpendicularly and removably mounted to said elongated tubular member at a predetermined position, said tray assembly including at least one flat portion removably mounted to said elongated tubular member; and E) at least one arm means for supporting said second tray assembly being removably mounted to said lateral wall.

3. The display set forth in claim 2 wherein two supporting walls are hingedly mounted to said lateral wall so that in the wheelbarrow configuration said hingedly mounted supporting walls are kept in a parallel and spaced apart relationship in respect to each other.

* * * * *